US009757976B2

(12) United States Patent
Menendez

(10) Patent No.: US 9,757,976 B2
(45) **Date of Patent: *Sep. 12, 2017**

(54) ASSEMBLY AND METHOD FOR TAPING WALLS FOR PAINTING STRIPES AND PATTERNS

(71) Applicant: Phillip Menendez, St. Louis, MO (US)

(72) Inventor: John Menendez, St. Louis, MO (US)

(73) Assignee: Phillip Menendez, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/537,616

(22) Filed: Nov. 10, 2014

(65) Prior Publication Data

US 2015/0059959 A1 Mar. 5, 2015

Related U.S. Application Data

(63) Continuation of application No. 12/990,522, filed as application No. PCT/US2009/042738 on May 4, 2009, now Pat. No. 8,881,416.

(Continued)

(51) Int. Cl.
*E04B 2/00* (2006.01)
*B43L 7/10* (2006.01)

(Continued)

(52) U.S. Cl.
CPC ..... *B44D 3/225* (2013.01); *B05C 17/00* (2013.01); *B05C 21/00* (2013.01); *B05C 21/005* (2013.01);

(Continued)

(58) Field of Classification Search
CPC .. B44D 3/00; B44D 3/225; B44D 3/22; E04G 21/1891; B05B 15/0456; B43L 7/10;

(Continued)

(56) References Cited

U.S. PATENT DOCUMENTS

RE2,220 E 4/1866 Simpson
407,350 A 7/1889 Hamilton (Continued)

OTHER PUBLICATIONS

Search Report for International Application No. PCT/US2009/042738 filed Dec. 24, 2009.

(Continued)

*Primary Examiner* — Alex Efta
(74) *Attorney, Agent, or Firm* — Polster Lieder

(57) ABSTRACT

Assemblies and methods for applying painter's tape to a wall for painting stripes thereon wherein the assembly has a first elongated body with a first straight outer edge, a second elongated body having a second straight outer edge with a substantially transparent body and having a tape width guide marking substantially along the elongated body with a plurality of elongated markings parallel to the second straight outer edge, two or more arms each having ends rotatably coupled to the first and second elongated bodies respectively, each of the arms being spaced apart of another and coupled at different positions of the elongated bodies, and a coupling mechanism rotatably coupling an arm to one of the elongated bodies and having a locking feature selectively fixing the angular position of the coupling mechanism and preventing rotation of the rotatably coupled arm relative to the coupled elongated body.

2 Claims, 5 Drawing Sheets

Related U.S. Application Data

(60) Provisional application No. 61/050,049, filed on May 2, 2008.

(51) Int. Cl.

| | |
|---|---|
| ***B44D 3/22*** | (2006.01) |
| ***B05C 21/00*** | (2006.01) |
| ***B44D 3/00*** | (2006.01) |
| ***B05C 17/00*** | (2006.01) |
| *B65H 37/00* | (2006.01) |
| *B43L 7/14* | (2006.01) |
| *B43L 7/12* | (2006.01) |
| *B05B 15/04* | (2006.01) |

(52) U.S. Cl.
CPC ..... *B43L 7/10* (2013.01); *B44D 3/00* (2013.01); *B44D 3/22* (2013.01); *B05B 15/0456* (2013.01); *B43L 7/125* (2013.01); *B43L 7/14* (2013.01); *B65H 37/005* (2013.01)

(58) Field of Classification Search
CPC ... B43L 7/12; B43L 7/125; B43L 7/14; B05C 17/12; B05C 21/00; B05C 21/005
See application file for complete search history.

(56) References Cited

U.S. PATENT DOCUMENTS 688,061 A * 12/1901 Bustanoby ..... B43L 7/125 33/454
1,059,797 A * 4/1913 Westbrook ..... B43L 7/125 33/454
1,238,536 A * 8/1917 Lin ..... G01B 3/56 33/419
1,600,246 A * 9/1926 Rehnqvist ..... B43L 7/12 33/454
1,746,537 A * 2/1930 Knechtel ..... B43L 7/12 235/70 A
2,151,427 A 3/1939 Houk
2,439,346 A 4/1948 Nash
3,364,088 A 1/1968 Seman et al.
3,625,798 A 12/1971 Ihli
3,673,690 A * 7/1972 De Barros ..... G01C 21/20 33/431
3,962,989 A 6/1976 Groff, Sr.
4,217,379 A 8/1980 Salvador
4,352,247 A * 10/1982 Rohde ..... B43L 13/00 33/428
4,383,496 A 5/1983 Shotwell et al.
4,524,527 A * 6/1985 Jeffrey ..... G01B 3/02 33/342
4,637,143 A * 1/1987 Telles ..... G01C 21/20 33/1 SB
5,224,269 A 7/1993 Vale-Caban et al.
5,445,703 A 8/1995 Steeves et al.
5,461,794 A 10/1995 Huang
5,472,029 A 12/1995 Ketch
5,478,432 A 12/1995 Vester
5,617,642 A 4/1997 Marios
5,628,866 A 5/1997 Pool
6,206,990 B1 3/2001 Glenn
6,694,633 B1 2/2004 Nyquist
RE38,449 E 3/2004 Glenn
6,804,894 B1 10/2004 Humphries
6,866,716 B1 3/2005 Montemurro
7,159,328 B1 1/2007 Duda
7,316,832 B2 1/2008 Steinhardt et al.
8,881,416 B2 * 11/2014 Menendez ..... B44D 3/00 33/454
2002/0066538 A1 6/2002 Lavelle
2002/0079061 A1 6/2002 Arnott
2004/0221754 A1 11/2004 Cochran et al.
2006/0141427 A1 6/2006 Harrigan

OTHER PUBLICATIONS

Wall Stripes by Jonathan Klunk, JonathanKlunk.com, Dec. 31, 2008, pp. 1-12.

* cited by examiner

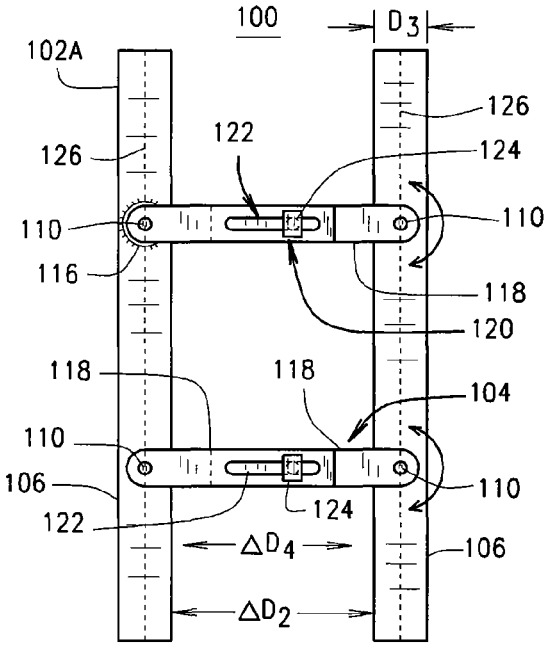
FIG. 3
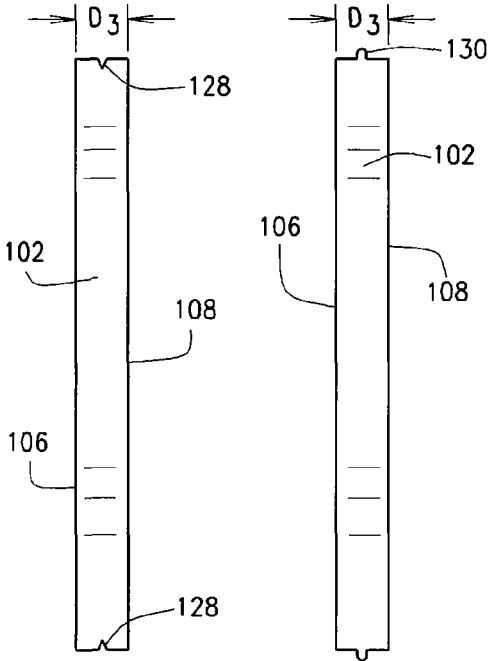
FIG. 4A
FIG. 4B
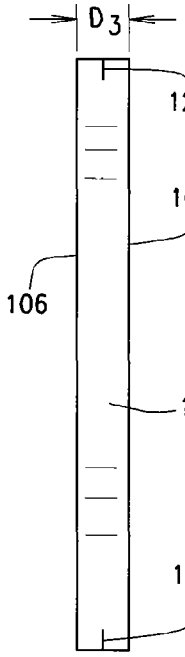
FIG. 4C
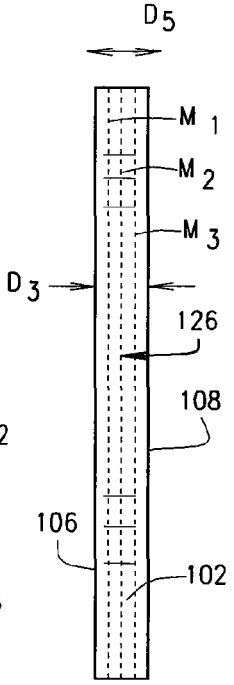
FIG. 4D

ASSEMBLY AND METHOD FOR TAPING WALLS FOR PAINTING STRIPES AND PATTERNS

CROSS-REFERENCE TO RELATED APPLICATIONS

This application is a continuation of U.S. National Stage application Ser. No. 12/990,522, which issued Nov. 11, 2014 as U.S. Pat. No. 8,881,416, which was a 35 U.S.C. §371 application of International Application Serial No. PCT/US2009/042738, having an International Filing Date of May 4, 2009, and which claimed priority to U.S. Provisional Patent Application Ser. No. 61/050,049 filed on May 2, 2008, each of which is herein incorporated by reference.

FIELD

The present disclosure relates to devices and methods for painting walls and, more specifically, to a guide for applying a tape to a wall for painting stripes or patterns on the wall with the aid of the applied tape.

BACKGROUND

The statements in this section merely provide background information related to the present disclosure and may not constitute prior art. When painting a wall, it is often desirable to apply tape to a wall surface so that the painter can apply paint over a base coat to form strips or other patterns. In applying the tape, alignment of the tape is critical to insure that the strips or patterns are parallel, and a consistent width. Additionally, it is often desirable to apply tape to a wall to form other painted patterns including triangles or other patterns.

However, existing devices and methods are either extremely complex and burdensome, and costly or do not allow for user adaptation for applying tape for painting non-vertical stripes, stripes of alternating widths or patterns other than stripes.

SUMMARY

The inventor hereof has succeeded at designing devices and methods applying tape to a wall such that parallel stripes or patterns can effectively and efficiently be applied and the wall painted for forming the stripes or patterns.

According to one aspect, an assembly for applying painter's tape to a wall for painting stripes and patterns on the wall includes a first elongated body defining a first straight outer edge and a first inner edge and having a first body length and a second elongated body defining a second straight outer edge and a second inner edge and having a second body length. The assembly also includes at least one arm having a first end rotatably coupled to the first elongated body and a second end rotatably coupled to the second elongated body, each of the arms having an arm length and configured to space the first elongated body apart from the second elongated body such that the first straight outer edge is a taping distance from the second straight outer edge.

According to another aspect, an assembly for painting stripes and patterns on a wall includes a first elongated body defining a first straight outer edge and a first inner edge and having a first body length defined by a first end and a second end and a second elongated body defining a second straight outer edge and a second inner edge and having a second body length defined by a first end and a second end. The assembly also includes two arms each having a first end rotatably coupled to the first elongated body and a second end rotatably coupled to the second elongated body. Each of the arms has the same arm length dimensioned to space the first elongated body apart from the second elongated body such that the first straight outer edge is a taping distance from the second straight outer edge.

According to yet another aspect, an assembly for painting stripes and patterns on a wall includes first means for aligning a first tape on the wall and second means for aligning a second tape on the wall wherein the alignment of the second tape is substantially parallel to the first tape and wherein the alignment of the second tape is configured to occur while the first means is still in alignment with the first tape. The assembly also includes means for selectively coupling the first means to the second means for aligning the second tape substantially parallel to the first tape, said means for selectively coupling including at least one rotatable coupling to each of the first and second means for aligning.

According to still another aspect, a method for painting stripes and patterns on a wall includes rotating an arm of an assembly relative to each of the connected first and second elongated bodies each having an outer edge while maintaining the first and second elongated bodies in parallel alignment to each other and spaced apart from one another, and selectively fixing the parallel position of the first elongated body relative to the second elongated body of the assembly. The method also includes positioning the assembly on the wall to be painted with the stripe or pattern, applying a first tape along an elongated portion of the wall adjacent to the first outer edge, and applying a second tape along an elongated portion of the wall adjacent to the second outer edge. The method further includes removing the assembly from the wall and painting a surface of the wall between the first tape and the second tape.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

FIG. 3 is a front view of an assembly for applying painter's tape to a wall according to a third exemplary embodiment.

FIGS. 4A-4D are front views of four alternative elongated bodies illustrating four additional tape guide features according to additional exemplary embodiments.

It should be understood that throughout the drawings, corresponding reference numerals indicate like or corresponding parts and features.

DETAILED DESCRIPTION

Figure 1:
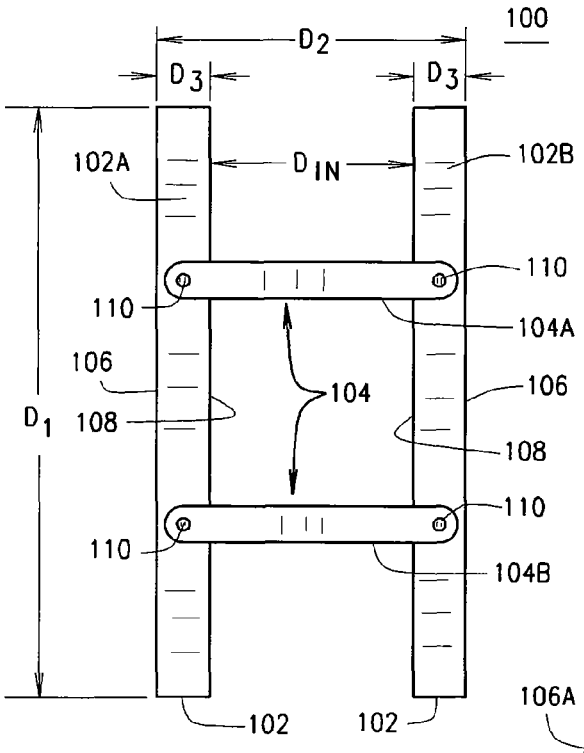
FIG. 1 is front view of an assembly for applying painter's tape to a wall according to one exemplary embodiment.

The following description is merely exemplary in nature and is not intended to limit the present disclosure or the disclosure's applications or uses.

Before turning to the figures and the various exemplary embodiments illustrated therein, a detailed overview of various embodiments and aspects is provided for purposes of breadth of scope, context, clarity, and completeness.

In some embodiments, an assembly for applying painter's tape to a wall for painting stripes and patterns on the wall includes a first elongated body defining a first straight outer edge and a first inner edge and having a first body length and a second elongated body defining a second straight outer edge and a second inner edge and having a second body length. The bodies can be made of any suitable material. One or both the elongated bodies can be made of a transparent or semi-transparent material such that a user can at least partially see through the body to aid in aligning the assembly with a marking line or edge of a previously placed tape or mark or otherwise. One or both of the bodies can also include a tape width guide marking, mark or indicia. For example, where a body is transparent the marking guide can be on the transparent portion for alignment by visualization through the body. In other embodiments, such tape width marking guides may be one or more other features on the top and/or bottom of the elongated body for alignment with an intermediate marking or alignment feature that is between the outer edge and the inner edge.

Generally, each of the bodies is elongated in that they define a substantial length as compared to their width. In some embodiments, each body has a length of greater than or about 10 inches with a width of 2 to 3 inches. In some embodiments, each body has a length of between about 10 inches and about 36 inches, but other lengths are also within the scope of this disclosure.

The assembly also includes at least one arm having a first end rotatably coupled to the first elongated body and a second end rotatably coupled to the second elongated body. Each of the arms can have a predetermined or variable arm length and configured to space the first elongated body apart from the second elongated body such that the first straight outer edge is a taping distance from the second straight outer edge. The arms can be made of any material and can be solid or transparent. Generally, such taping distance can range between about 4 and about 12 inches, but other distances are also possible and within the scope of the present disclosure.

In some embodiments, there are two or more arms, one near a top or at the top of first ends of the two bodies and the other spaced apart from the first and at or second ends of the two bodies. Each arm can be rotatably coupled to each of the first and second elongated bodies such that the parallel alignment of the first and second outer edges can be maintained parallel to each other while the bodies are rotated relative to one or both of the arms. In other embodiments, two arms can be configured to overlap and in some cases to form an X-shaped and can be coupled together, either fixedly or rotationally.

In some embodiments, the first and second elongated bodies include an elongated arm mounted slot. The first arm can be rotatably coupled to a second arm at a midpoint and each arm has a first end rotatably coupled to each elongated body at a fixed point and a second end rotatably coupled to each elongated body at a variable point along one of the elongated arm mounting slots. In such an embodiment, movement of the second end within the elongated arm mounting slot rotates the first arm relative to the second arm for establishing the arm length from among a plurality of arm lengths and thereby varying the distance between the two outer edges for varying the distance between the applied tape to adapt to the preferred distance of the user.

It is also possible that the first arm includes an arm slot for coupling to the second arm at a variable point along their length. In such embodiments, the point of coupling the mid-points of the two arms can provide for varying the angular deflection of the bodies relative to the arms while also maintaining a parallel position to each other.

In some embodiments, a radial scale (such as a protractor or angular deflection markings) are provided adjacent to at least one of the first end or the second end of the arm and the coupling of the arm to at least one of the elongated bodies.

In some embodiments, the arm lengths are fixed and in other embodiments the arm lengths are variable such that a user can adjust the length of the arms to provide a selectable arm length from among a plurality of arm lengths. For example, in some embodiments, each arm includes a first arm component, a second arm component, and an arm component coupler for selectively fixing a lateral position of the first arm component relative to the second arm component and therefore selectively fixing the distance between the two outer edges.

A plurality of coupling mechanisms are each configured for rotatably coupling each arm to each of the first and second elongated bodies. Such coupling mechanism can be any suitable coupler, and can include a pin and hole, a bolt, a rivet or similar rotatable coupler. In some embodiments, one or more of the coupling mechanisms can include a locking feature configured for selectively fixing the angular position of the coupling mechanism and preventing rotation of the rotatably coupled arm relative to the coupled body. Such a locking mechanism can be a locking nut or wing nut or can be a push pin or other suitable device or arrangement for selectively locking an angular position of rotatable coupling mechanism.

In some embodiments, the assembly can also include a handle or other hand grasping feature so as to enable a user to grasp the assembly and manipulate the assembly with a single hand during operation. Such a grasping feature can be located on one or more of the arms or on one or more of the bodies.

In some embodiments, a level or leveling feature, such as a bubble level or otherwise can also be adapted with the assembly. The level can be mounted to or integrated with one or more of the arms for leveling the assembly during operation. In other embodiments, a level can be on one or both the bodies.

In one embodiment, an assembly for painting stripes and patterns on a wall includes a first elongated body defining a first straight outer edge and a first inner edge and having a first body length defined by a first end and a second end and a second elongated body defining a second straight outer edge and a second inner edge and having a second body length defined by a first end and a second end. The assembly also includes two arms each having a first end rotatably coupled to the first elongated body and a second end rotatably coupled to the second elongated body. Each of the arms has the same arm length dimensioned to space the first elongated body apart from the second elongated body such that the first straight outer edge is a taping distance from the second straight outer edge.

Referring now to the figures, FIG. 1 illustrates an exemplary embodiment of an assembly 100 having two bodies 102 (individually shown as 102A and 102B) positioned apart by two arms 104 (individually shown as 104A and 104B). The two bodies 102 define outer edges 106 and have inner edges 108, with a body length of D1, wherein each outer edge 108 is spaced apart by the arms 104 at a distance of D2, each inner edge spaced apart by distance Din, and each elongated body having a body width of D3. In this exemplary embodiment, the arms 104 have fixed lengths with an end coupled to each of the two bodies 102 by either fixed or rotatable coupling mechanism 110. As shown, the fixed distance D2 is defined by the lengths of the arms and the widths D3 of each body 102. It should be noted that the coupling mechanism 110 can provide for a rotation of the connection between the body 102 and the arm 104 on each end, and in such embodiments, one or more coupling mechanisms 110 can include a locking feature (not shown) wherein the user can selectively lock the angle of connection between the bodies 102 and the arm 104. Such angle is shown in FIG. 1 as 90 degrees, but this angle can be an angle other than 90 degrees.

Figure 2:
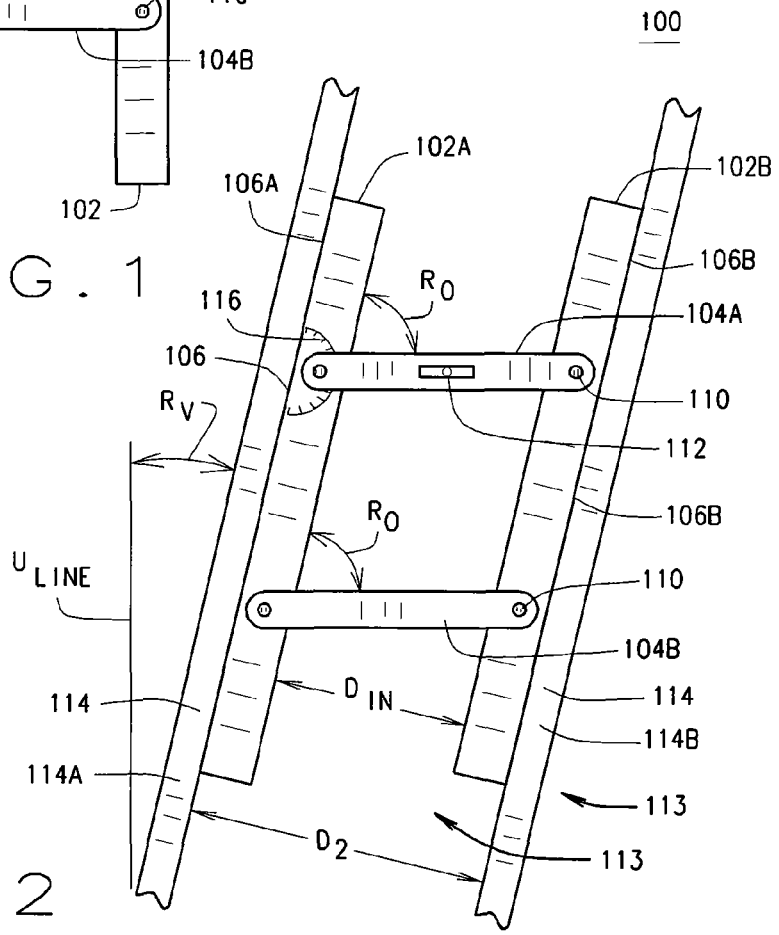
FIG. 2 is a front view of an assembly for applying painter's tape to a wall according to a second exemplary embodiment.

FIG. 2 illustrates another embodiment that is similar to that of FIG. 1 except in this case the arms 104 are rotated in relation to the bodies 102 at an angle R0 and therefore can be positioned at an angle RV relative to a vertical or plumb line Vline. As known to those skilled in the art, Ro will be equal to RV. In such embodiments, the angular deflection of the bodies 102 relative to a vertical line Vline during the operation of the assembly 100 on a wall 113 can provide for applying tape 114 along each outer edge 106 that are parallel to each other but at the fixed angle RV on the wall being taped and to be painted. However, a level 112 such as a bubble level can be positioned along one of the arms 104 so that the arms 104 can be leveled by the user during use. Additionally, a radial scale 116 or indicia (such as a protractor) is provided at the coupling of the first arm 104A to the first body 102A for designating and selecting the angular deflection RO of the bodies 102 relative to the arms 104. Generally, in use, the arms 104 can be consistent level and therefore the bodies 102 are consistently positioned on the wall 113 at a consistent angle RV. As shown, the user has applied a first tape 114A along the outer edge 106A and a second tape 114B along the second outer edge 114B, at a fixed parallel distance of D2.

FIG. 3 is yet another exemplary embodiment of an assembly 100 having variable length arms 104 that provide for a variable distance D4 between the two bodies 102 and therefore between the two outer edges D2. As shown in this embodiment, each arm 104 includes two or more arm segments 118 that can be configured for providing a variable length to each arm 104. In this embodiment, two arm segments 118 are coupled by an arm coupling 120. The arm coupling 120 can be a coupling for selectively fixing the connection between two segments for selectively fixing the length of the arm 104. As shown in FIG. 3, the arm coupling 120 can include a slot 122 and arm locking mechanism 124 positioned about the slot 122 for selectively fixing the length of the arms 104 by the user. The arms 104 can also be rotatable relative to each body 102 and be attached using a coupling mechanism 110 for selectively fixing the angular position of the arms 104 relative to the bodies 102. The bodies 102 can be of any material but in some embodiments can be of a transparent material. In some cases, a tape alignment line 126 can be provide on a transparent body 102 or can be positioned so that they bodies 102 can be aligned while viewing a previously placed tape 114 on the wall 113 to be taped and painted with lines.

FIGS. 4A, 4B, 4C, and 4D illustrate alternative tape alignment guides or marks that can include alignment formations or slots (FIG. 4A), protrusions (FIGS. 4B and 4C) or multiple indicia lines that can correspond to various tape widths (FIG. 4D). As shown in FIG. 4A, each body 102 can include an alignment recess 128 at each end for alignment with a placed tape 114 or previously painted line. FIG. 4B illustrates an alignment protrusion 130 as another embodiment. FIG. 4C illustrates the alignment line 126 that is only positioned at either end of the body 102 and FIG. 5D illustrations a plurality of alignment lines 126 each spaced apart at predetermined distances M1, M2, and M3, such distances can equate to the varying widths of various tapes 114.

Figure 5A:
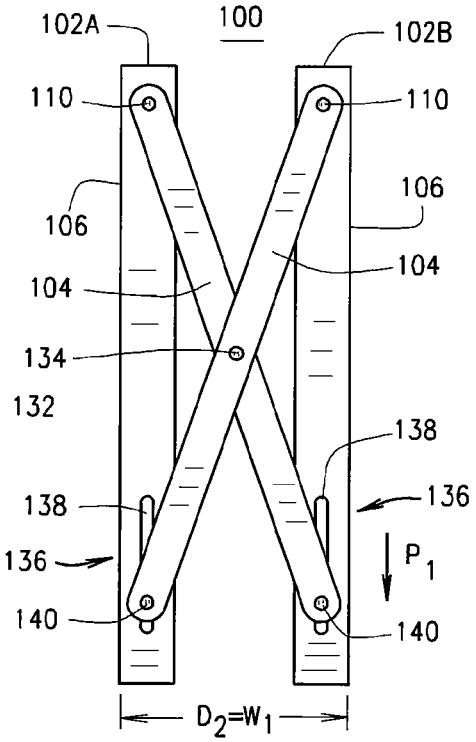
FIGS. 5A and 5B are two front views of an assembly for applying painter's tape to a wall according to a fourth exemplary embodiment.
Figure 5B:
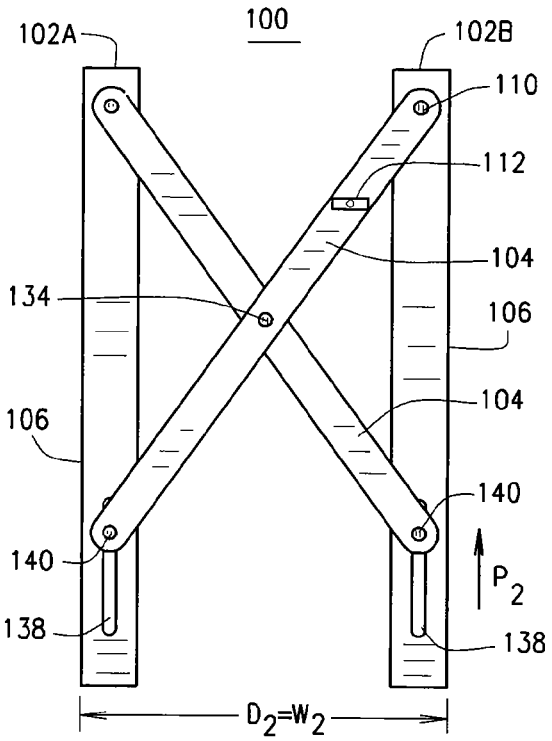
Figure 6:
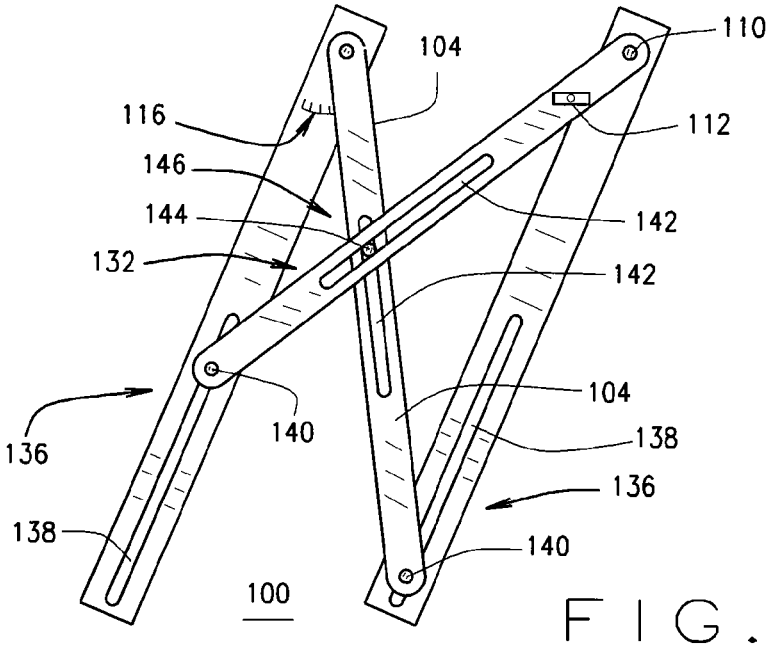
FIG. 6 is a front view of an assembly for applying painter's tape to a wall according to a fifth exemplary embodiment.

FIGS. 5A and 5B illustrate another exemplary embodiment of an assembly 100 having a scissor arm 132 assembly wherein each arm 104 is rotatably coupled to each other with a rotary coupling 134 to an upper end of each body 102 and a rotatable and slidable coupling 136 at the lower end of the other body 102. As shown, the rotatable and slidable coupling 136 can be, in one embodiment, a slot 138 on each body 102 with a slidable mounting fixture 140 one each arm 104. In this configuration, the distance D2 between the two outer edges 106 can be variable while still maintaining parallel relationship. FIG. 5A shows the two bodies 102 being in close proximity to each other for defining a distance D2 of a narrow taping width W1. By moving the lower slidable mounting fixture 140 upward, the arms 104 rotate relative to each other and the bodies 102A and 102B move apart to form a different wider distance D2 that is now wider taping width W2 as shown in FIG. 5B. A variation of such embodiments is shown in FIG. 6. In this assembly 100, an arm slot 142 and slidable coupling 144 provides for a variable slidable coupling 146. As shown, the slidable coupling 146 is positioned between the mid-points of the two arms 104 while also being slidable at the lower portions of each body 102. In this configuration, the two bodies 102A and 102B can be angularly deflected as shown while also providing for the parallel alignment of the two outer edges 106 for taping.

Figure 7A:
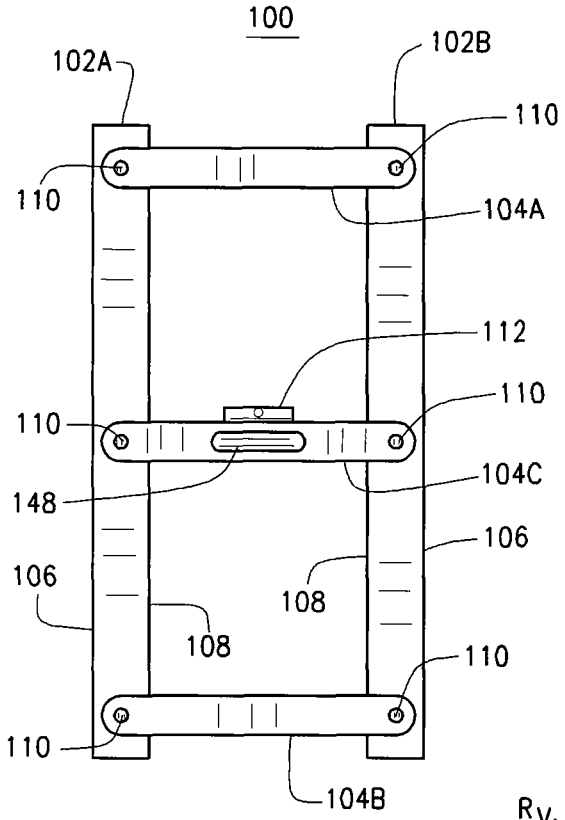
FIGS. 7A and 7B are front views of an assembly for applying painter's tape to a wall according to a sixth exemplary embodiment.
Figure 7B:
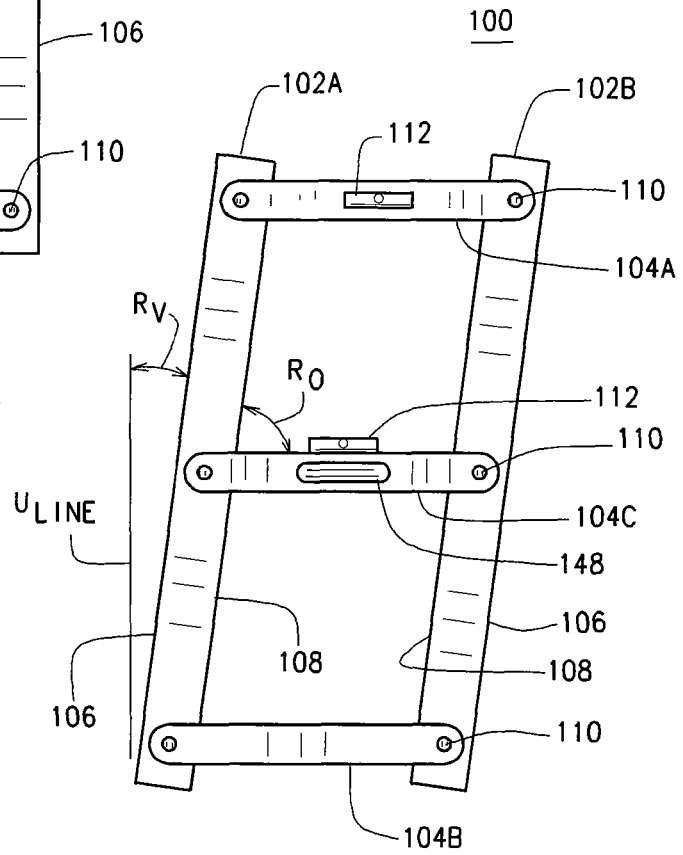

FIGS. 7A and 7B illustrate an alternative embodiment of that of FIG. 1. In this embodiment, the first and second arms 104A and 104B are positioned proximate to the upper and lower ends of the bodies 102. A third arm 104C is positioned about the center of each body 102 and includes a handle 148 for grasping the assembly 100 and a bubble level 112 for consistently leveling the arms 104 by the user during operation of the assembly 100. FIG. 7A illustrates the assembly 100 used wherein each outer edge 106 is plumb and parallel to each other. FIG. 7B illustrates the same assembly 100 of FIG. 7B wherein the arms 104 are level but with the bodies 102 being at an angle RO relative to each arm 104 that is other than 90 degrees and as such, each outer edge 106 is at the angle RV as compared to the vertical lines Vline.

In operation, one or more of the embodiments as described above can provide a user with an improved method for applying tape to a wall and painting a pattern on the wall. In one embodiment, a method for painting stripes and patterns on a wall includes rotating an arm of an assembly relative to each of the connected first and second elongated bodies each having an outer edge while maintaining the first and second elongated bodies in parallel alignment to each other and spaced apart from one another, and selectively fixing the parallel position of the first elongated body relative to the second elongated body of the assembly. The method also includes positioning the assembly on the wall to be painted with the stripe or pattern, applying a first tape along an elongated portion of the wall adjacent to the first outer edge, and applying a second tape along an elongated portion of the wall adjacent to the second outer edge. The method further includes removing the assembly from the wall and painting a surface of the wall between the first tape and the second tape.

The method can also include repeating the positioning, applications, and removing a plurality of repetitions for taping a plurality of repeated and alternating first and second tapes to the wall. In such a method, all first and second tapes are parallel to each other about the surface of the wall. Following the repeated positioning, applications, and removing, the method includes repeating the painting of the surface to only between every first tape and second tape.

The method can also include removing the first and second tape following the painting, and/or leveling the assembly during position of the assembly on the wall using a level integrated within one of the arms of the assembly.

The method can further include orienting the arm relative to one of the first and second elongated bodies using a radial scale associated with the assembly during the rotating the arm relative to the first and second elongated bodies.

Figure 8:
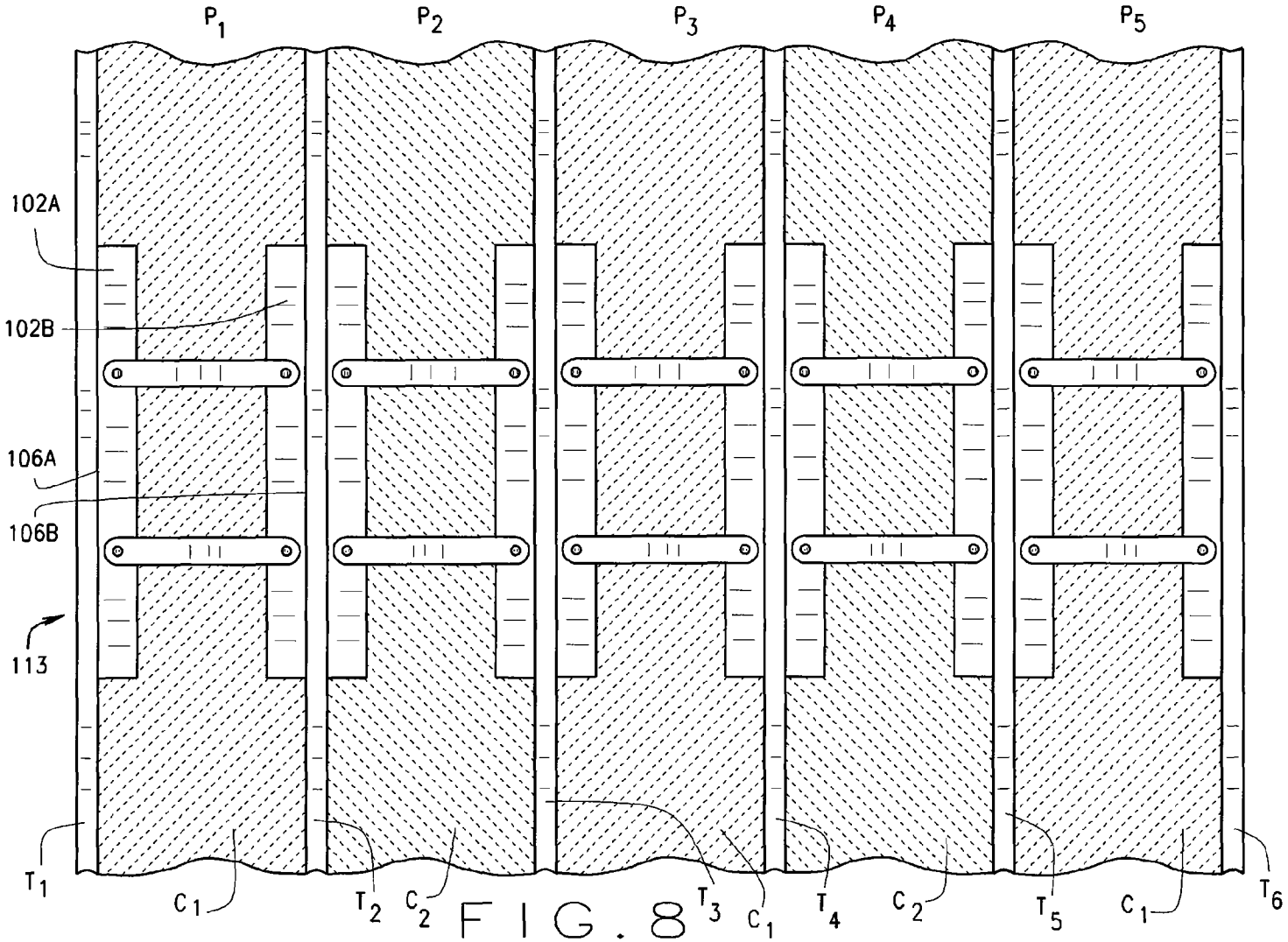
FIG. 8 is a front view of a wall having been taped and painted using an assembly for applying painter's tape according to one exemplary embodiment.

One method of operation of one assembly is illustrated in FIG. 8 in taping and painting a wall. As shown in repetitive fashion, the assembly 100 or taping guide is first placed in position P1 at the far left. A first tape T1 and a second tape T2 are applied to the wall 113 along outer edges 106A and 106B, respectively. The assembly 100 is moved onto the right of the second tape T2, aligned and the third tape T3 is applied along outer edge 106B. Next, the assembly 100 is moved to the right edge of the third tape T3 and the fourth tape T4 is applied, and that process is repeated for the entire wall 113 to be taped for striped painting. The left body 102A can be aligned to the outer left edge of the aligning tape, or can be overlapped to align a tape guide marking, such as alignment mark 126, that is intermediate between the outer edge 106 and inner edge 108 of the left body 102A. By alternating between the alignment with the outer edge 106 and then with an intermediate alignment mark 126, the widths of the lines CX to be painted, that are alternating, can produce stripes or patterns that have the same width Cx. As shown in FIG. 8, alternative colors C1 and C2 have been painted between the various tapes Tx. As will be known to those skilled in the art, the taping of the width of the wall 113 must consider the width of the tape Tx (or 114) such that the taped portions accommodate for such width. If such is not provided, the alternating tape widths can result in alternating stripes of two different widths, which may or may not be desired.

After the taping process is completed, each alternating tape pattern can be painted such as color C2 and leaving the intermediate lines the base paint color C1. Once the paint is applied, the tape can be removed. Such painting of the alternating taped portions is shown in FIG. 8 for illustrative purposes only.

Those skilled in the art will also understand that the assemblies as described herein can also be used for taping one or two sets of patterns some being angularly offset to the right and some to the left. In such applications of the assemblies, methods can provide for taping of patterns for painting triangles or other geometric shapes.

As described herein, those skilled in the art of painting can see that the assemblies as described in this disclosure can provide for significant improvements over other devices, assemblies, and methods for taping a wall for painting stripes or patterns on the wall. One or more assemblies can be used to paint a wall as described herein and can be selectively chosen or configured to obtain stripes and patterns of a wide variety of widths and for application to a wide variety of lengths of wall space.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A method for painting stripes and patterns on a wall comprising:

rotating an arm of an assembly having a first elongated body defining a first straight outer edge and a first inner edge and having a first body length, a second elongated body defining a second straight outer edge that is in a direction opposite of a direction of the first straight outer edge and a second inner edge facing towards the first inner edge of the first elongated body, the second elongated body having a second body length, the second elongated body having a substantially transparent body and has a tape width guide marking substantially along the elongated body with a plurality of elongated markings parallel to the second straight outer edge, two or more arms with each having a first end rotatably coupled to the first elongated body and a second end rotatably coupled to the second elongated body, each of the arms being spaced apart of another of the two or more arms and coupled at different positions of the first and second elongated bodies, each arm having an arm length and defining a selectable spacing between the first elongated body apart from the second elongated body and such that the first straight outer edge is a taping distance from the second straight outer edge, and one or more coupling mechanisms each configured for rotatably coupling each arm to each of the first and second elongated bodies at fixed positions thereon, wherein at least one of the coupling mechanisms includes a locking feature for selectively fixing the angular position of the coupling mechanism and preventing rotation of the rotatably coupled arm relative to the coupled elongated body;

selectively fixing the parallel position of the first elongated body relative to the second elongated body of the assembly by selective activation of the locking feature;

positioning the assembly on the wall to be painted with the stripe or pattern;

applying a first tape along an elongated portion of the wall adjacent to the first outer edge;

applying a second tape along an elongated portion of the wall adjacent to the second outer edge;

removing the assembly from the wall; and painting a surface of the wall between the first tape and the second tape.

2. The method of claim 1, further comprising:

repeating the positioning, applications, and removing a plurality of repetitions for taping a plurality of repeated and alternating first and second tapes to the wall wherein all first and second tapes are parallel to each other about the surface of the wall; and following the repeated positioning, applying, and removing, repeating the painting of the surface to only between every first tape and second tape.

* * * * *